US009673002B2

(12) United States Patent
Miyata et al.

(10) Patent No.: US 9,673,002 B2
(45) Date of Patent: Jun. 6, 2017

(54) DOUBLE SEESAW SWITCH

(71) Applicant: Mik Denshi Kohgyo Co., Ltd., Tokyo (JP)

(72) Inventors: Muneyoshi Miyata, Tokyo (JP); Nobuji Hasegawa, Tokyo (JP)

(73) Assignee: Mik Denshi Kohgyo Co., Ltd., Tokyo (JP)

( * ) Notice: Subject to any disclaimer, the term of this patent is extended or adjusted under 35 U.S.C. 154(b) by 0 days.

(21) Appl. No.: 15/223,919

(22) Filed: Jul. 29, 2016

(65) Prior Publication Data

US 2017/0032910 A1 Feb. 2, 2017

(30) Foreign Application Priority Data

Jul. 30, 2015 (JP) ..... 2015-150334

(51) Int. Cl.
*H01H 19/00* (2006.01)
*H01H 21/00* (2006.01)
*H01H 21/24* (2006.01)

(52) U.S. Cl.
CPC ..... *H01H 21/24* (2013.01)

(58) Field of Classification Search
CPC ..... H01H 19/00; H01H 21/00; H01H 21/24; H01H 3/00; H01H 3/04; H01H 9/02; H01H 13/50; H01H 21/02; H01H 21/04; H01H 21/06; H01H 21/08; H01H 21/18; H01H 21/22; H01H 21/42; H01H 23/0016; H01H 23/025; H01H 23/24; H01H 2009/02; H01H 2221/00; H01H 2221/016; H01H 2221/074; H01H 2223/00; H01H 2223/002
USPC ... 200/558, 1 R, 5 R, 5 A, 11 E, 11 G, 11 A, 200/552, 553, 293, 303, 329, 332, 333, 200/335, 336, 339, 345, 17 R, 18, 344, 200/557
See application file for complete search history.

(56) References Cited

U.S. PATENT DOCUMENTS 9,373,466 B2 * 6/2016 Sasaki ..... H01H 23/06

FOREIGN PATENT DOCUMENTS

| | | |
|---|---|---|
| JP | 2001-035309 A | 2/2001 |
| JP | 2009-032519 A | 2/2009 |
| JP | 2014-229530 A | 12/2014 |

* cited by examiner

*Primary Examiner* — Anthony R. Jimenez
(74) *Attorney, Agent, or Firm* — Muncy, Geissler, Olds & Lowe, P.C.

(57) ABSTRACT

A double seesaw switch has two seesaw switches arranged side-by-side inside a case. Each of the two seesaw switches has a central terminal arranged on a bottom surface inside the case, a pair of fixed contacts separately arranged, a moving contact supported pivotably with respect to the central terminal and has a contact portion for contacting one of the fixed contacts, an operation body supported rotatably with respect to the case, and pivots the moving contact by moving on the moving contact in correspondence with a rotation movement of the operation body, and a biasing part biasing the operation body towards a neutral position. The biasing part is a leaf spring piece formed in a U shape from a portion of a ceiling surface of the case, and to press against the operation body in a power storing state of a leading end portion compressed.

1 Claim, 7 Drawing Sheets

SECT D-D

SECT B-B

SECT C-C

DOUBLE SEESAW SWITCH

CROSS REFERENCE TO RELATED APPLICATION(S)

This application claims priority under 35 USC 119 to Japanese Patent Application No. 2015-150334 filed on Jul. 30, 2015, the entire contents which are incorporated herein by reference.

TECHNICAL FIELD

The present invention relates to a double seesaw switch suitable for use as a switch for operating, for example, motorized seats in an automobile.

BACKGROUND

An example of this type of switch is the seat switch described in Patent Document 1 below. In this switch, a moving contact bent into a V shape is provided on a fixed contact arranged on a base, and an operation member arranged on the moving contact is operated slidingly to pivot the moving contact like a seesaw and change contacts, hence the name 'seesaw switch.'

In a seesaw switch, the operation member comprises an operating shaft incorporating a knob, a spring holder for accommodating a coil spring, and a protrusion coming into contact with the moving contact. The coil spring accommodated in the spring holder biases the protrusion towards the moving contact. When the operation member is operated slidingly, the protrusion on the operation member is moved onto the movable contact while the force of the coil spring is continuously applied.

RELATED ART

Patent Document(s)

[Patent Doc. 1] JP Laid-Open Patent Application Publication 2009-32519 (see FIG. 4)

However, when a seesaw switch with this configuration is used as a seat switch, the number of spring holders and coil springs required corresponds to the number of operation members. This increases the number of parts. As a result, the assembly of the parts is more complicated and switch manufacturing costs increase.

It is an object of the present invention to solve this problem by providing a double seesaw switch with a reduced number of parts, simplified assembly, and lower switch manufacturing costs.

SUMMARY

A double seesaw switch disclosed in the application has two seesaw switches arranged side-by-side inside a case, each of the two seesaw switches has a central terminal that is arranged on a bottom surface inside the case, a pair of fixed contacts that are separately arranged so as to interpose the central terminal therebetween, a moving contact that is supported pivotably with respect to the central terminal serving as a fulcrum and has a contact portion for contacting one of the fixed contacts, an operation body that is supported rotatably with respect to the case, and pivots the moving contact by moving on the moving contact in correspondence with a rotation movement of the operation body, and a biasing part that biases the operation body towards a neutral position. The biasing part is a leaf spring piece that is bent and formed into a U shape by cutting into and raising a portion of a ceiling surface of the case, and is configured to press against the operation body in a power storing state in which a leading end portion that is to be a free end of the U-shaped leaf spring piece is compressed.

In a double seesaw switch of the present invention, the two spring holders and two coil springs in the prior art are replaced by a structure in which an operation body is biased by a leaf spring piece provided in the ceiling surface of the case, thereby reducing the number of parts, simplifying assembly, and decreasing switch manufacturing costs.

BRIEF DESCRIPTION OF THE DRAWINGS

FIGS. 1A-1D are a set of drawings showing a double seesaw switch of the present invention in which FIG. 1A is a top view, FIG. 1B is a front view, FIG. 1C is a right side view, and FIG. 1D is a vertical cross-sectional view FIGS. 2A-2D are a set of drawings showing the base and contact pattern constituting the double seesaw switch of the present invention in which FIG. 2A is a top view, FIG. 2B is a cross-sectional view from B-B, FIG. 2C is a cross-sectional view from C-C, and FIG. 2D is a cross-sectional view from D-D.

FIGS. 3A-3E are a set of drawings showing the base and contact pattern constituting the double seesaw switch of the present invention in which FIG. 3A is a top view, FIG. 3B is a right side view, FIG. 3C is a front view, FIG. 3D is a detailed view of section D, and FIG. 3E is an assembled view on the base.

FIGS. 4A-4C is a set of drawings showing the moving contact constituting the double seesaw switch of the present invention in which FIG. 4A is a top view, FIG. 4B is a front view, and FIG. 4C is a cross-sectional view from C-C.

FIGS. 5A-5D are a set of drawings showing the operation body constituting the double seesaw switch of the present invention in which FIG. 5A is a top view, FIG. 5B is a front view, FIG. 5C is a right side view, and FIG. 5D is a bottom view.

FIGS. 6A-6D are a set of drawings showing the top case constituting the double seesaw switch of the present invention in which FIG. 6A is a top view, FIG. 6B is a front view, FIG. 6C is a bottom view, and FIG. 6D is a right side view.

FIGS. 7A and 7B are a pair of drawings used to explain the operation of a double seesaw switch of the present invention in which FIG. 7A is a cross-sectional view showing the switch in the free position, and FIG. 7B is a cross-sectional view showing the switch in the operating position.

DETAILED DESCRIPTION OF THE EMBODIMENTS

The following is an explanation of an embodiment of the present invention with reference to the drawings.

Figure 1A:
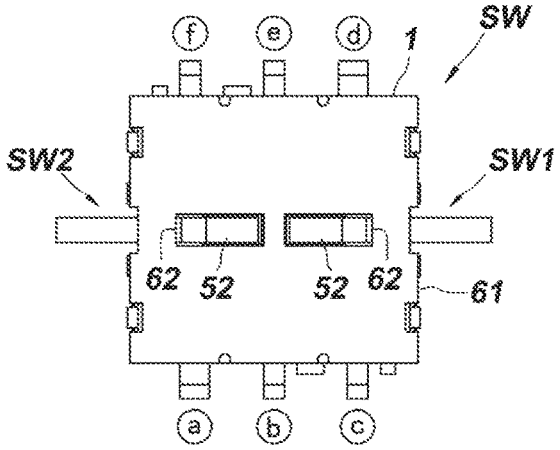
Figure 1B:
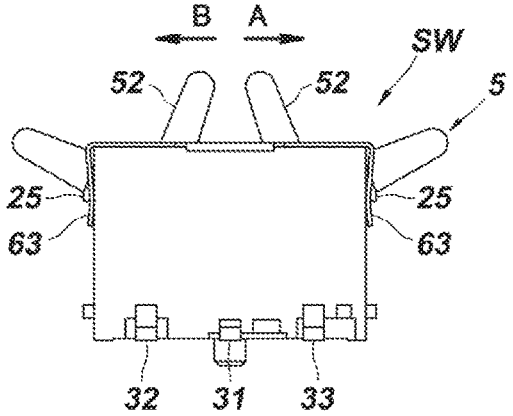
Figure 1C:
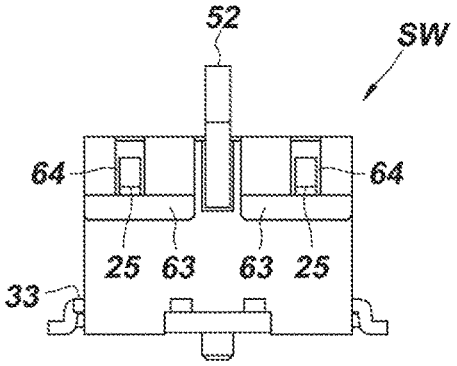
Figure 1D:
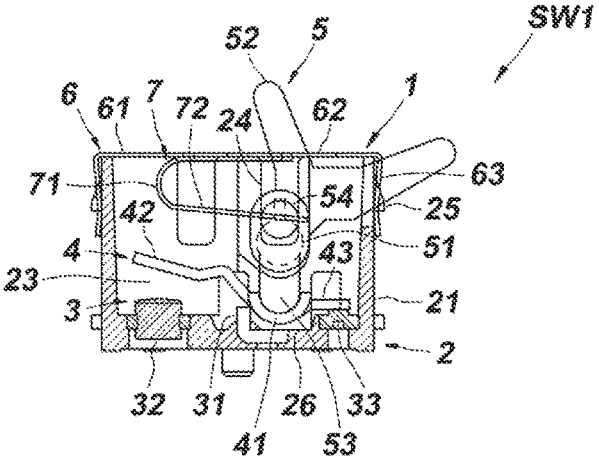
Figure 2A:
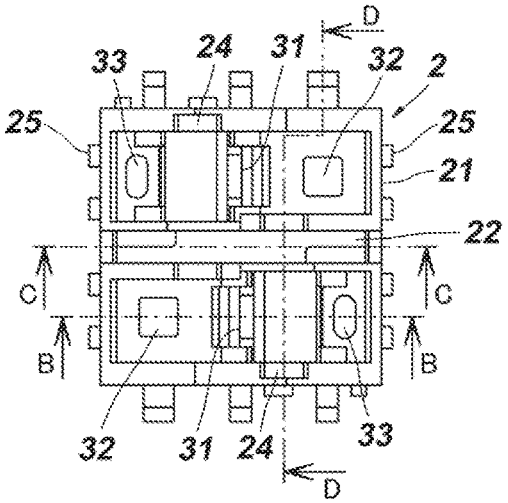
Figure 2D:
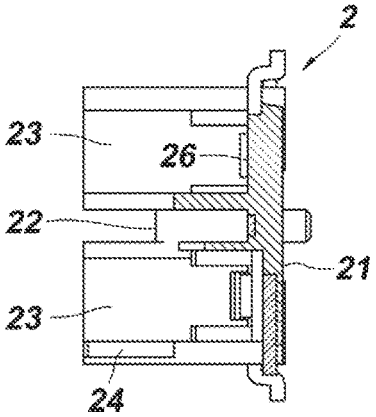
Figure 2B:
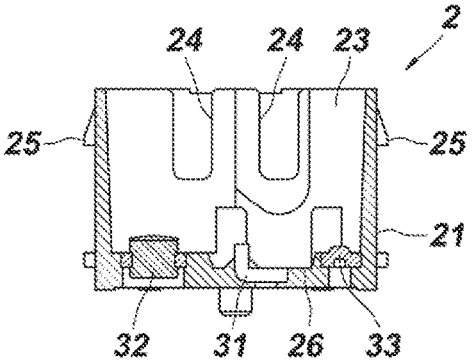
Figure 2C:
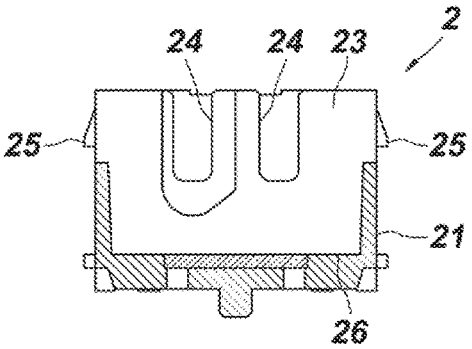

The double seesaw switch SW of the present embodiment shown in FIGS. 1A-1D can be used as a switch for operating a motorized seat or power window in an automobile. Here, two seesaw switches SW1, SW2 are arranged side-by-side and symmetrically inside a case 1. As shown in FIG. 1D, the double seesaw switch SW comprises a base 2, a contact pattern 3, a moving contact 4, an operation body 5, and a top case 6. The following is an explanation of each component and the structure as a whole.

The base 2 shown in FIGS. 2A-2D is made of a resin material with insulating properties (a 'liquid crystal polymer' or LCP in the present embodiment), and the square box-shaped main body 21 is partitioned by a central partitioning wall 22 into two switch housing chambers 23, 23 arranged longitudinally. Recessed portions 24, 24 are formed on the inner walls of the front surface and the rear surface of each switch housing chamber 23 for rotatably supporting the operation body 5 described below. Claws 25, 25 are formed in the outer walls of the left and right side surfaces for attaching the top case 6 described below. A pedestal 26 is provided on the floor surface of each switch housing chamber 23 for arranging the contact pattern 3 described below.

Figure 3A:
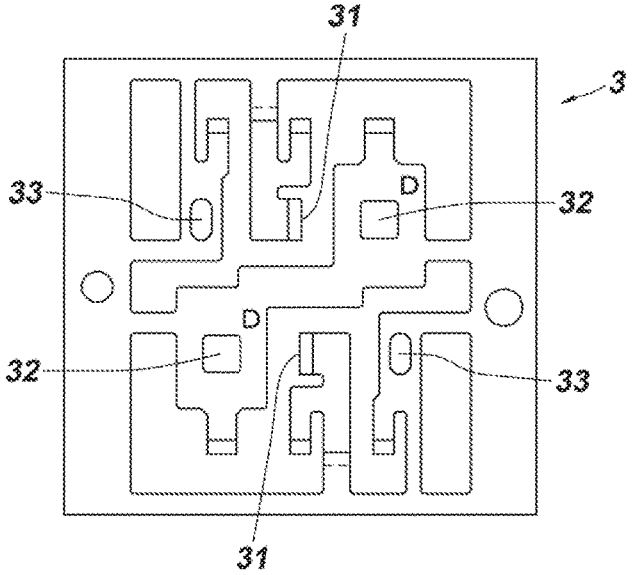
Figure 3B:
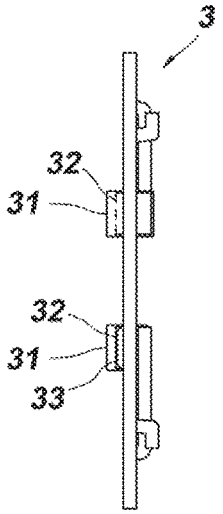
Figure 3C:
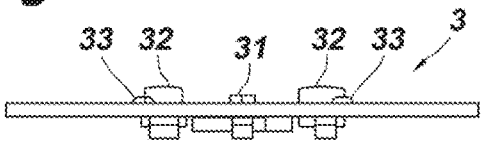
Figure 3D:
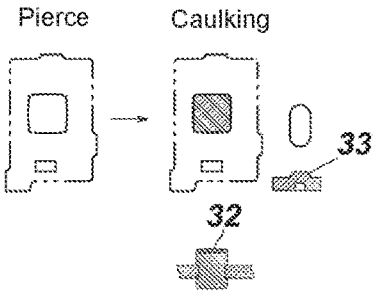
Figure 3E:
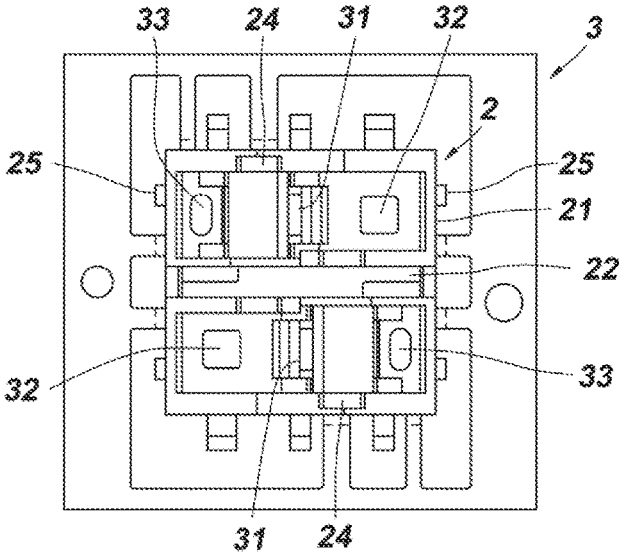

The contact pattern 3 shown in FIGS. 3A-3D is a metal plate with conductive properties (a copper plate in the present embodiment) stamped into a predetermined pattern and insert-molded in the base 2. After the insert molding, the dotted-line portions in the drawing are cut from the metal plate. In the present embodiment, central terminals (terminal b, terminal e) composed of metal pieces standing vertically are arranged in the center of the pedestals 26, and pairs of fixed contacts 32, 33 (contact a and contact c, contact d and contact f) are separately arranged on the left and right sides so as to interpose the central terminals 31 therebetween. The central terminals 31 and the fixed contacts 32, 33 protrude outside the base 2 from inside the switch housing chambers 23. In the present embodiment, at the electrical contacts of the inner fixed contact 32 and outer fixed contact 33, a hole is opened (pierced) as shown in FIG. 3D, and caulked using an AgCu alloy. The piercing operation is shown in the left and the caulking operation is shown in the right.

Figure 4A:
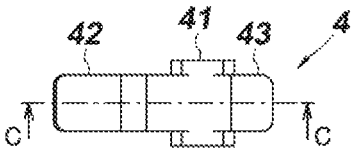
Figure 4B:
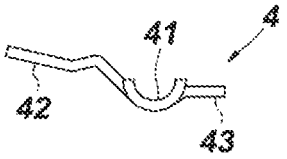
Figure 4C:
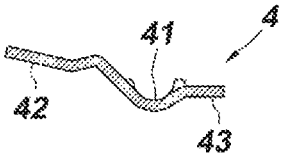
Figure 5A:
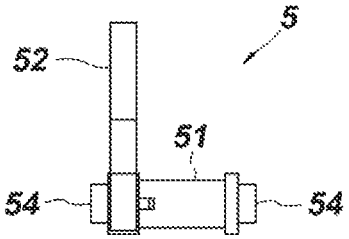
Figure 5B:
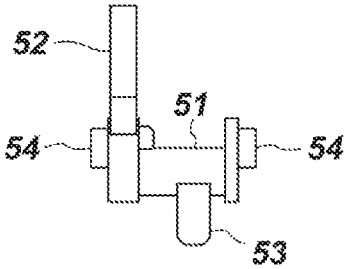
Figure 5C:
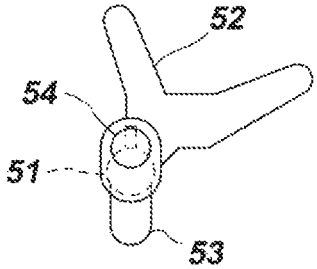
Figure 5D:
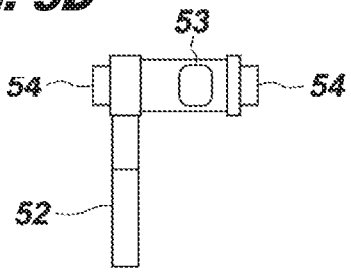
Figure 6A:
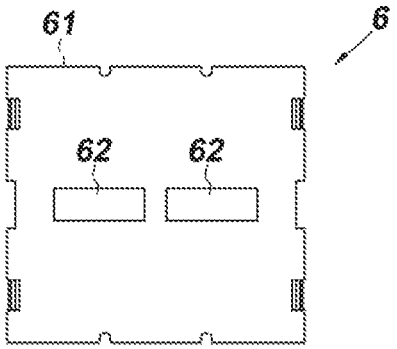
Figure 6B:
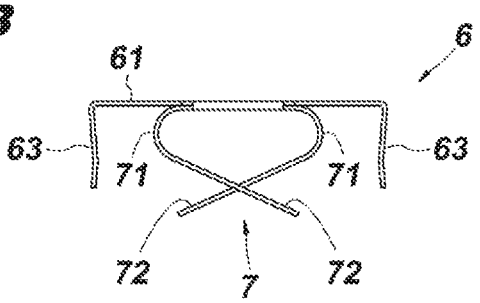
Figure 6C:
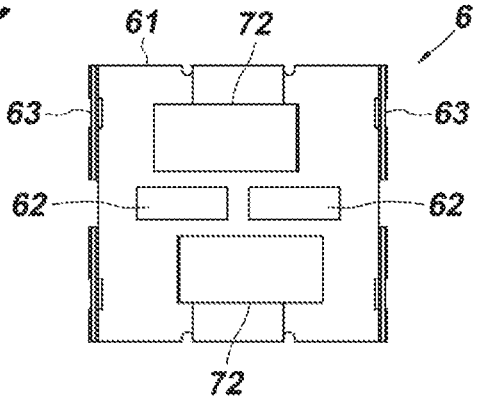
Figure 6D:
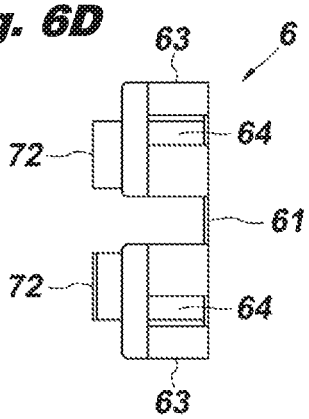

The moving contact 4 shown in FIGS. 4A-4C is provided on the base 2 on which the contact pattern 3 is arranged. The moving contact 4 is a metal piece having conductive properties (a copper piece in the present embodiment) whose central portion has been bent into a curved shape. This is arranged on the central terminal 31 with the curved portion 41 facing downward. In this way, the moving contact 4 is always in contact with the central terminal 31 and pivotally supported like a seesaw with the central terminal 31 serving as the fulcrum. Contact portions 42, 43 coming into contact with the fixed contacts 32, 33 are provided on both sides of the curved portion 41.

The operation body 5 shown in FIGS. 5A-5D is provided on the moving contact 4. The operation body 5 is made of a resin material having insulating properties (PA46 in the present embodiment), and includes a column-shaped main body 51, a lever 52 extending in the shape of an L upward from the back surface of the main body 51, and a protruding portion 53 protruding on the floor surface of the main body 51. A pair of support shafts 54, 54 are formed on the front surface and the rear surface of the main body 51 and are centered on a position slightly above the centerline of the main body 51. These support shafts 54 are inserted into the recessed portions 24 of the base 2 such that the operation body 5 is rotatably supported by the support shafts 54. Also, the protruding portion 53 of the operation body 5 is fitted into the curved portion 41 of the moving contact 4 such that the operation body 5 causes the moving contact 4 to pivot by moving on the moving contact 4 in correspondence with the rotation movement of the lever 52.

In addition, the operation body 5 is configured such that it is always biased towards the moving contact 4, a predetermined amount of contact pressure is obtained during operation, and it returns to a neutral position when there is no load. In the present embodiment, the top case 6 shown in FIGS. 6A-6D is used as the biasing part.

The top case 6 shown in FIGS. 6A-6D is a steel plate having sufficient elasticity and mechanical strength (a stainless steel plate in the present embodiment). A pair of openings 62, 62 are formed in the ceiling panel 61 covering the entire base 2 to allow the lever 52 of the operation body 5 to protrude outward. Mounting pieces 63, 63 are integrally provided in the left and right side surfaces of the ceiling panel 61. A pair of leaf spring pieces 7, 7 for biasing the operation body 5 are provided on the rear surface of the top case 6 which serves also as the ceiling surface of the case 1. The leaf spring pieces 7 are bent and formed into a U-shape 71 by cutting into a portion of the top case 6 and raising the portion so as to obtain a sufficient amount of spring action on the leading end portion 72 that is to be a free end. The top case 6 is placed over the base 2 and the claws 25 on the base 2 are engaged with the mounting holes 64 formed in the mounting pieces 63 to secure the top case 6 to the base 2.

In this way, as shown in FIGS. 1A-1D, the case 1 is created which consists of the base 2 and the top case 6, and the double seesaw switch SW is completed in which a single seesaw switch SW1, SW2 is provided in each of the two switch housing chambers 23, 23 divided longitudinally. When the top case 6 is attached to the base 2, the leaf spring pieces 7 integrally formed in the top case 6 are pressed down, the leading end portions 72, 72 of the pair of leaf spring pieces 7, 7 are compressed, and the main bodies 51, 51 of the pair of operation bodies 5, 5 are each pressed by a leaf spring piece in a power storing state.

The structure of the double seesaw switch SW in the present embodiment was explained above. The following is an explanation of the operation of the switch with reference to FIG. 7A, FIG. 7B, and FIG. 8.

Figure 7A:
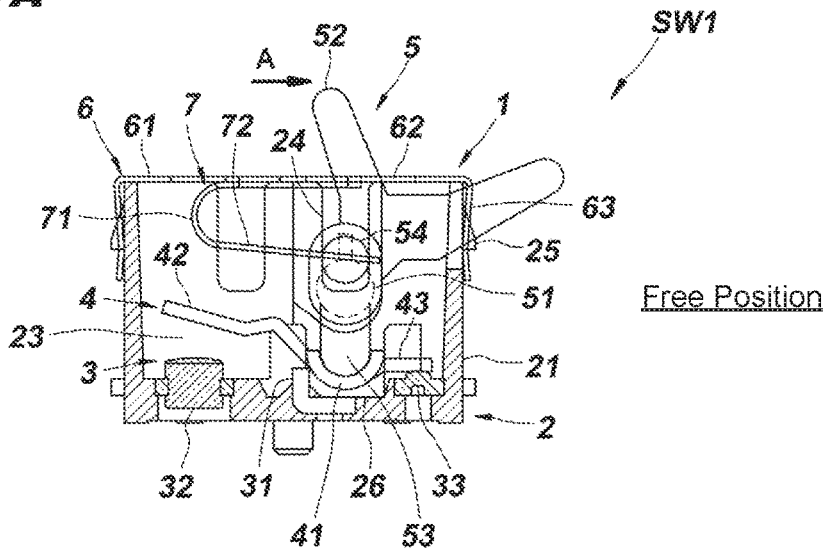
Figure 8:
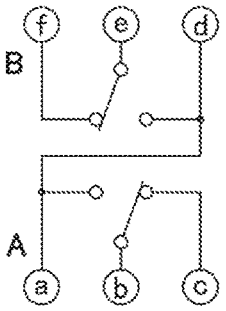
FIG. 8 is a circuit diagram of a double seesaw switch of the present invention.

When in the no load (or free) state shown in FIG. 7A, the leading end portion 72 of the leaf spring piece 7 presses down on the main body 51 of the operation body 5 from above, and the protruding portion 53 on the leading end is fitted into the curved portion 41 of the moving contact 4. At this time, the moving contact 4 maintains an equilibrium, the curved portion 41 comes into contact with the central terminal 31, and the outer contact portion 43 makes contact with the outer fixed contact 33. However, the inner contact portion 42 is separated from the inner fixed contact 32. Thus, as shown in FIG. 8, the central terminal 31 (terminal b) and the outer fixed contact 33 (contact c) are connected via the moving contact 4. At this time, the switch is turned OFF (or switch OFF state).

When the lever 52 on the operation body 5 is moved in the direction of arrow A in FIG. 7A, the operation body 5 rotates clockwise around the support shaft 54, the main body 51 pushes up the leading end portion 72 of the leaf spring piece 7, and the leaf spring piece 7 is elastically deformed. Also, the protruding portion 53 of the operation body 5 is pulled out of the curved portion 41 of the moving contact 4, and the moving contact 4 begins to move on the moving contact 4. At this time, the outer contact portion 43 of the moving contact 4 is lifted away from the outer fixed contact 33 (contact c) with the contact point between the curved portion 41 and the central terminal 31 serving as the fulcrum. At this time, the switch begins to turn ON.

Figure 7B:
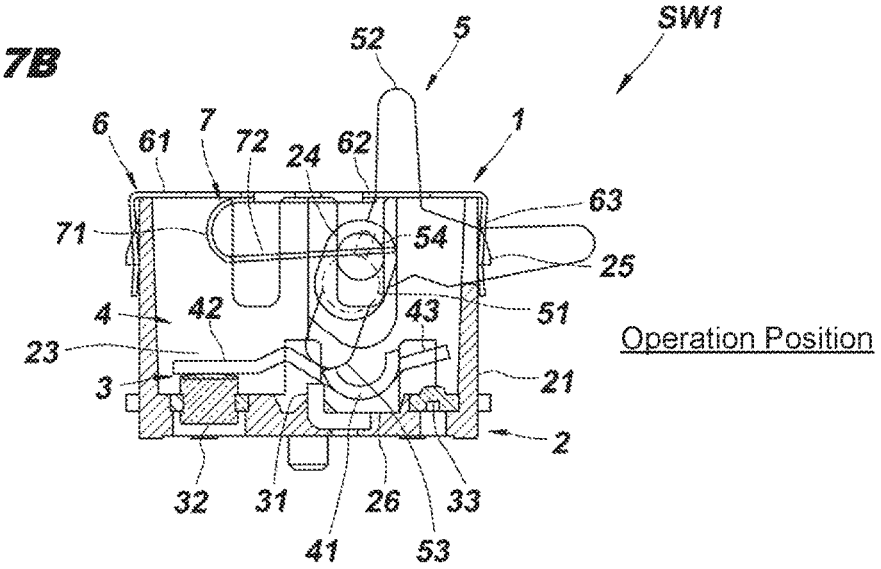

Next, when the lever 52 of the operation body 5 is moved further in the direction of arrow A, the operation body 5 rotates around the support shaft 54, the main body 51 pushes the leading end portion 72 of the leaf spring piece 7 upwards, and the leaf spring piece 7 is compressed. The protruding portion 53 of the operation body 5 moves over the moving contact 4 and runs up the inclined surface to the very top. At this time, as shown in FIG. 7B, the moving contact 4 shifts its center of gravity and tilts to the left with the contact point between the curved portion 41 and the central terminal 31 serving as the fulcrum. The inner contact portion 42 then comes into contact with the inner fixed contact 32. Therefore, in FIG. 8, the central terminal 31 (terminal b) and the inner fixed contact 32 (contact a) are connected via the moving contact 4, and the contacts switch. At this time, the switch has been turned ON (or switch ON state).

When the force being applied to the lever 52 is released, the compressed leaf spring piece 7 is restored, and the leaf spring piece 7 presses against the operation body 5 as shown in FIG. 7A. The protruding portion 53 on the leading end is fitted into the curved portion 41 of the moving contact 4, the operation body 5 is restored to the neutral position, and the moving contact 4 is restored to the equilibrium state. At this time, the switch is turned to the OFF state. In FIGS. 7A and 7B, the operation of the seesaw switch SW1 in the front of the device was explained (the operation in direction A of FIG. 1B). However, the operation of the seesaw switch SW2 in the rear of the device (the operation in direction B of FIG. 1B) is the same, so further explanation has been omitted.

In the double seesaw switch SW of the present invention, as explained above, the two spring holders and two coil springs in the prior art are replaced by a structure in which an operation body is biased by a leaf spring piece provided in the ceiling surface of the case, thereby reducing the number of parts, simplifying assembly, and decreasing switch manufacturing costs. The present invention is not limited to the present embodiment. Any modification devisable by those of ordinary skill in the art can be included within the technical scope of the present invention.

What is claimed is:

1. A double seesaw switch having two seesaw switches arranged side-by-side inside a case, each of the two seesaw switches comprising:

a central terminal that is arranged on a bottom surface inside the case, a pair of fixed contacts that are separately arranged so as to interpose the central terminal therebetween, a moving contact that is supported pivotably with respect to the central terminal serving as a fulcrum and has a contact portion for contacting one of the fixed contacts, an operation body that is supported rotatably with respect to the case, and pivots the moving contact by moving on the moving contact in correspondence with a rotation movement of the operation body, and a biasing part that biases the operation body towards a neutral position, wherein the biasing part is a leaf spring piece that is bent into a U-shape by cutting into and raising a portion of a ceiling surface of the case such that the biasing part is integrally formed with the ceiling surface of the case, and is configured to press against the operation body in a power storing state in which a leading end portion that is to be a free end of the U-shaped leaf spring piece is compressed.

* * * * *